US007635279B1

(12) United States Patent
Wong et al.

(10) Patent No.: US 7,635,279 B1
(45) Date of Patent: Dec. 22, 2009

(54) ELECTRICAL CABLE CONNECTOR

(76) Inventors: Memie Mei Mei Wong, 7th Floor, Block 2, Leader Industrial Centre, 188-202 Texaco Rd., Tsuen Wan, New Territories (HK); Sam Yun Sum Wong, 7th Floor, Block 2, Leader Industrial Centre, 188-202 Texaco Rd., Tsuen Wan, New Territories (HK)

( * ) Notice: Subject to any disclaimer, the term of this patent is extended or adjusted under 35 U.S.C. 154(b) by 0 days.

(21) Appl. No.: 12/342,236

(22) Filed: Dec. 23, 2008

(51) Int. Cl.
*H01R 4/26* (2006.01)

(52) U.S. Cl. ..... 439/419

(58) Field of Classification Search ..... 439/395, 439/403–404, 417–419
See application file for complete search history.

(56) References Cited

U.S. PATENT DOCUMENTS 5,601,448 A 2/1997 Poon
6,364,690 B1 4/2002 Nehm-Engelberts
7,063,556 B1 6/2006 Wong et al.
7,156,686 B1 * 1/2007 Sekela et al. ..... 439/403
7,429,186 B2 * 9/2008 Mrakovich et al. ..... 439/404

* cited by examiner

*Primary Examiner*—Khiem Nguyen
(74) *Attorney, Agent, or Firm*—Leydig, Voit & Mayer, Ltd.

(57) ABSTRACT

An electrical cable connector includes a housing, a holder movable to bring and hold the cable in engagement with the housing, and an operator for moving the holder, through screw action, to hold the cable in engagement with the housing. The holder has opposed left and right limbs extending upwards. Two electrical conductors within the housing have sharp lower ends for piercing the cable to contact a respective core of the cable when the cable is brought into engagement with the housing, and upper ends for connection with a second electrical cable. The upper end of each of the conductors includes a self-gripping device which grips the end of a core of the second cable automatically, upon approach of the end of the core, electrically and mechanically connecting the end of the core to the upper end of the conductor.

13 Claims, 4 Drawing Sheets

10
100
200
300
400
401
430
311
213
212
21
20
22
401/22
IVA
VIA

ELECTRICAL CABLE CONNECTOR

The present invention relates to an electrical cable connector that is particularly but not exclusively useful for power connection of garden lights in a landscape lighting system.

BACKGROUND OF THE INVENTION

Along a low-voltage power supply cable, need may arise to draw electrical power from the cable at any specific position for supplying power to an electrical device, such as a light/lamp in the garden where lighting is desired. A special type of electrical connector is used for this purpose, which is mounted on the cable at that position and is then screwed tight to pierce a pair of sharp pins into the cable cores for extracting power.

Connectors of this type are known in general, such as the ones disclosed in U.S. Pat. Nos. 5,601,448 and 6,364,690, but they are not convenient to use, for example the cable leading to the electrical device is cumbersome to connect or disconnect.

The invention seeks to mitigate or at least alleviate such shortcoming by providing a new or improved electrical cable connector of the type concerned.

SUMMARY OF THE INVENTION

According to the invention, there is provided an electrical cable connector for use on an electrical cable for drawing electrical power therefrom, comprising a housing having a lower side for engaging a said electrical cable and an upper side opposite the lower side, a holder provided on the lower side of the housing for relative movement to bring and hold a said electrical cable in engagement with the lower side of the housing, and an operator provided on the upper side of the housing for moving the holder in the operating direction, through screw action, to thereby hold a said electrical cable in engagement with the lower side of the housing. The holder has a pair of opposed left and right limbs extending in an operating direction from the lower side to the upper side of the housing. A plurality of electrical conductors are located within the housing, each of the conductors having a sharp lower end for piercing into a said electrical cable to make contact with respective core thereof upon a said electrical cable being brought into engagement with the lower side of the housing, and an upper end for connection with a second electrical cable.

The upper end of at least one of the conductors includes a self-gripping device which operatively grips upon the end of a core of a said second electrical cable automatically and simultaneously upon approach of the end of the core, thereby electrically and mechanically connecting the end of the core to the upper end of said at least one of the conductors.

Preferably, the self-gripping device comprises a resiliently bendable gripping member which is operatively bent inwardly by and upon approach of the end of the core of a said second electrical cable and is co-operable with an adjacent support for subsequently gripping and connecting the end of the core.

More preferably, said at least one of the conductors has two adjacent first and second upper ends, the first upper end providing the gripping member and the second upper end providing the support.

More preferably, the self-gripping device is associated with a manually-operable release member which operatively bends the gripping member inwardly to open the self-gripping device thereby releasing the end of the core of a said second electrical cable.

Further more preferably, the release member is resiliently biased by the gripping member towards an inoperative position.

Yet further more preferably, the release member includes a press knob for manual movement from the inoperative position to an inner operative position while bending the gripping member.

Yet further more preferably, the housing has a wall behind which the self-gripping device and the release member are located adjacent together, the wall having a first hole which exposes the gripping device for insertion of the end of the core of a said second electrical cable and a second hole through which the press knob protrudes out for depression in the same direction as said insertion of the end of the core.

In a preferred embodiment, the left and right limbs of the holder have external screw threads, and the operator surrounds the left and right limbs and has an internal screw thread in engagement with the screw threads of the left and right limbs for moving the holder through screw action, the internal screw thread extending through an angle falling short of 360°.

More preferably, the internal screw thread consists of one single continuous screw thread.

In a preferred embodiment, the housing and the operator include inter-engageable elements which inter-engage through snap engagement such that the operator is rotatably engaged with the housing.

More preferably, the inter-engageable elements comprise a circular flange on one of the operator and housing and at least one protrusion on the other of the operator and housing, the protrusion snapped with the rim.

Further more preferably, the flange is part of the operator, and the housing includes said at least one protrusion adjacent a recess that receives the flange.

Yet further more preferably, the inter-engageable elements include a pair of said protrusions which are positioned on diametrically opposite sides of the flange.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 2:
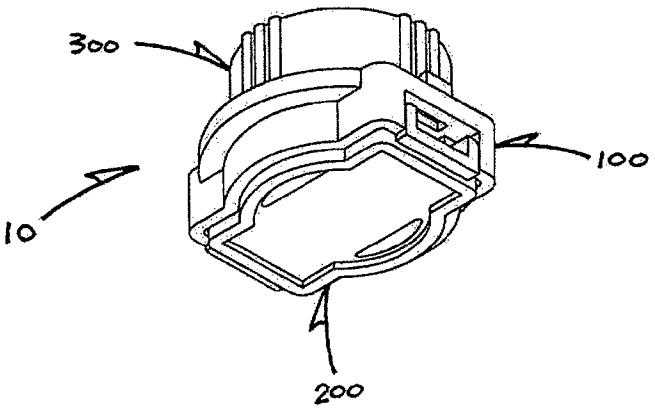
FIG. 2 is a bottom perspective view thereof.
Figure 1:
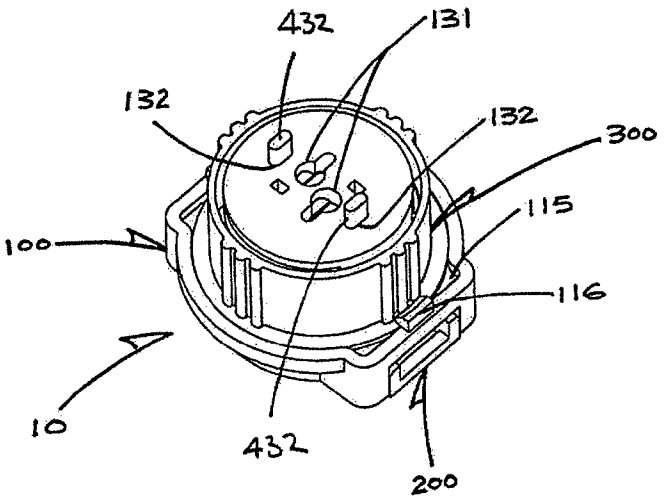
FIG. 1 is a top perspective view of an embodiment of an electrical cable connector in accordance with the invention.

Referring to the drawings, there is shown an electrical cable connector 10 embodying the invention for use upon an electrical power cable 20, which is connected to a low-voltage power supply (e.g. 12V), for drawing electrical power from that cable 20. The cable 20 typically comprises a pair of conductive cores 22 protected by an insulating sheath 21.

The cable connector 10 has a housing 100, a holder 200 below the housing 100 and having a U-shaped channel 210 for locating the power cable 20, and an operator 300 on the housing 100 for operating the holder 200. All three components are separate parts moulded from plastics material. A pair of copper connector pins 400 is located symmetrically within the housing 100 for making electrical connection with respective cores 22 of the cable 20 held by the holder 200, upon operation of the operator 300.

The housing 100 is a hollow integral structure having a horizontal oblong base 112 which has an apertured base wall 113 on its upper side and a lower side that is fully open, and a central hub 111 on the base wall 113. The hub is generally cylindrical and largely hollow, having a narrow body 111A and a circular top plate 111B thereon. The base wall 113 has a pair of slots 114 on opposite left and right sides of the hub body 111A. With its opposite ends 117 being almost fully open, the base 112 defines a downwardly-open channel 118 that extends lengthwise of the base 112.

The entire edge of the base wall 113 is raised to form a short wall that defines a shallow recess 115 around the hub 111. Symmetrically at each end of the base wall 113 there is a small protrusion 116 which is located directly on the raised edge and it hangs over the recess 115 for a small distance. The protrusion 116 has an inclined upper side sloping into the recess 115 (at about 60°), acting as a hook 116 capable of performing a snap-fit action.

The holder 200 has a horizontal oblong base 211 and a pair of vertical limbs 212 which project upwardly from opposite sides of the base 211, together forming a U-shaped structure with a channel 210 between the limbs 212. The base 211 is shaped and dimensioned to fit within the channel 116 of the housing base 112, and the limbs 212 through the slots 114 respectively. The limbs 212 are formed with external screw threads 213.

The operator 300 is provided by a turning knob 310 which resembles a cylindrical collar with external ribbing to assist gripping. The turning knob 310 has an outer bottom flange 312 around its lower rim and a single turn of internal screw thread 311 on its inner surface slightly back from the rim. This screw thread 311 is a continuous thread that extends through an angle falling short of 360°, by only less than about 10°.

The turning knob 310 is disposed around the hub 111, with its bottom flange 312 lowered into the recess 115 and snapped past the hooks 116 at opposite ends of the recess 115, whereby the knob 310 is snap-fit engaged with the housing 100 and the two parts are assembled together. Stated opposite, the hooks 116 snap past the flange 312, on diametrically opposite sides thereof. The hooks 116 connect and keep the turning knob 310 in place by its bottom flange 312, yet permitting free turning of the knob 310 relative to the housing 100.

The holder 200 is designed to be inserted from below into the housing 100, with its limbs 212 passing through respective slots 114 into the turning knob 310 on opposite sides of the hub body 111A, whereupon the limbs' screw threads 213 come into engagement with the knob's screw thread 311. The knob 310 may then be turned clockwise to advance the holder 200 through a screw action, thereby pulling it upwardly, in an operating direction, closer to the underside of the base wall 113. Upon reversed turning, the knob 310 will push the holder 200 away and eventually release it from the housing 100. The base wall 113 of the housing 100 has two apertures 119 flanked by its slots 114, which are symmetrical about the centre. The apertures 119 extend upwardly deep into the hub body 111A, forming two chambers 120 which are open downwards on the underside of the base wall 113. In these chambers 120 the two connector pins 400 are separately located.

Each of the connector pins 400 has a sharp lower end 401 for piercing into a respective core 22 of the power cable 20 to make electrical connection therewith. It includes a pair of rectangular upper contact ends 402 and 403 to allow external connection of another, second electrical cable for supplying power to a garden light for example.

The first contact end 402 originates from the same upright straight copper strip 410 as the lower end 401. The second contact end 403 comes from a second copper strip 420 which is fixed to and supported by the lower portion of the first copper strip 410. The second copper strip 420 is folded into a rectangular shape such that its contact end 403 generally points at, and bears against, the other contact end 402 transversely on one side thereof. The transverse contact end 403 is inclined at a small angle downwards/inwards.

Compared with the first copper strip 410, the second copper strip 420 is made of a springy copper material such that the second contact end 403 is inwardly bendable away from the first contact end 402 and can, upon release, self-return under its own resilience to re-engage the first contact end 402, thereby providing a self-gripping device G.

Each connector pin 400 is inserted from below into a corresponding chamber 120. Upon the pin 400 being fully inserted, its transverse contact end 403 will be aligned with and hence accessible through a small hole 131 in the hub's top plate 111B. The relative dimensions are such that the sharp lower end 401 is left projecting from the underside of the base wall 113, into the base channel 118.

The chambers 120 are each partitioned into two rooms, with an inner room for holding the corresponding connector pin 400 with associated gripping device G and an outer room for locating a release member 430 for releasing the gripping device G next door.

The release member 430 is in the form of an upright rectangular platelet 431 which has a vertical press-knob 432 projecting centrally from the upper end of the platelet 431 and includes a small stud 433 projecting horizontally from one side near the press-knob 432. The release member 430 is inserted from below into the outer room, with its press-knob 432 sticking out through a small hole 132 in the hub's top plate 111B and its stud 433 reaching slightly into the inner room next door.

The connector pin 400 for the inner room is installed after the release member 430 such that its transverse contact end 403 bears against the stud 433 from below and thus holds the release member 430 next door in place. Under the resilient action of the transverse contact end 403 upon its stud 433, the release member 430 is biased upwards.

The release member 430 may be pressed downwards by its press-knob 432 to in turn bend the transverse contact end 403 away from the upright contact end 402, thereby opening the self-gripping device G (from FIGS. 7 and 7A to FIGS. 8 and 8A).

Figures 4, 4A, 5, 5A, 6, 6A:
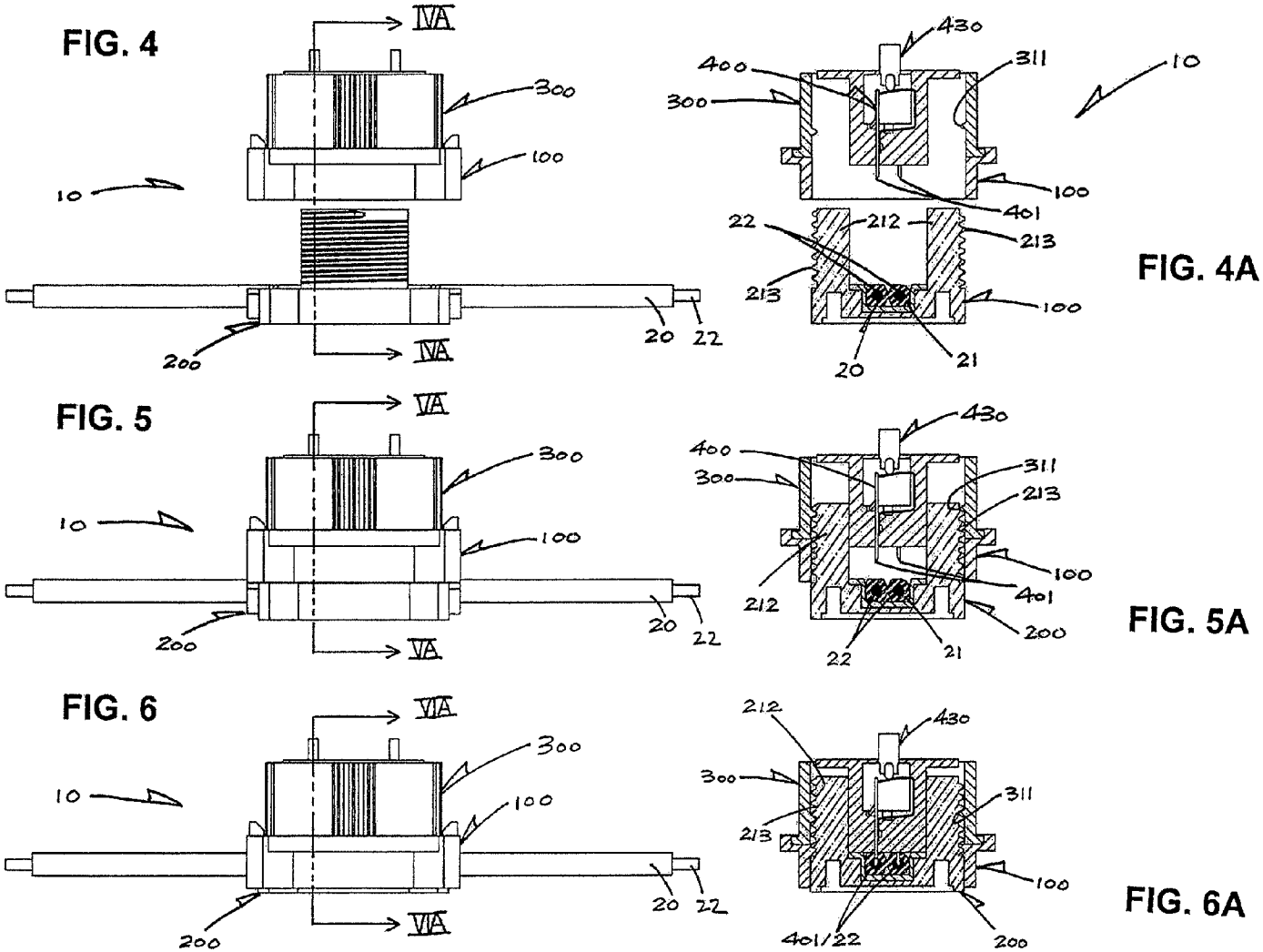
FIG. 4 is a first side view of the connector and an electrical cable about to be connected by the connector.
FIG. 4A is a cross-sectional view of the connector and cable of FIG. 4, taken alone line IVA-IVA.
FIG. 5 is a second side view similar to FIG. 4, showing the cable being connected by the connector.
FIG. 5A is a cross-sectional view of the connector and cable of FIG. 5, taken alone line VA-VA.
FIG. 6 is a third side view similar to FIG. 5, showing the cable finally connected by the connector.
FIG. 6A is a cross-sectional view of the connector and cable of FIG. 6, taken alone line VIA-VIA.
Figure 7A:
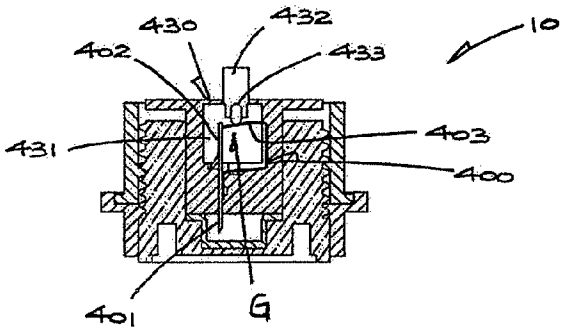
FIG. 7A is a cross-sectional view of the connector of FIG. 7 taken alone line VIIA-VIIA, showing a self-gripping device thereof.
Figure 8A:
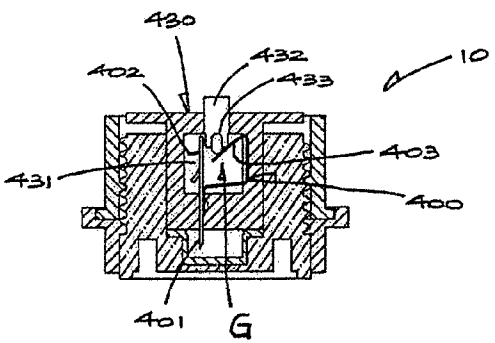
FIG. 8A is a cross-sectional view of the connector of FIG. 8 taken alone line VIIIA-VIIIA, showing the self-gripping device being opened.
Figure 7:
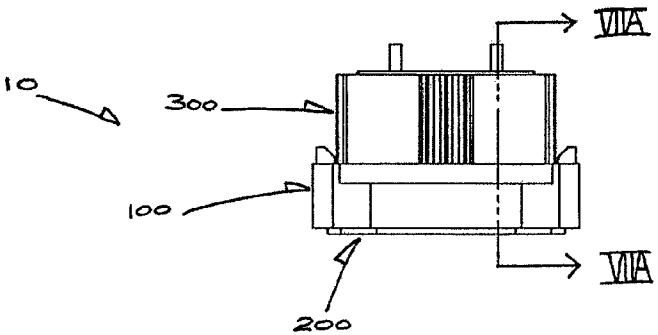
FIG. 7 is an end view of the connector.
Figure 8:
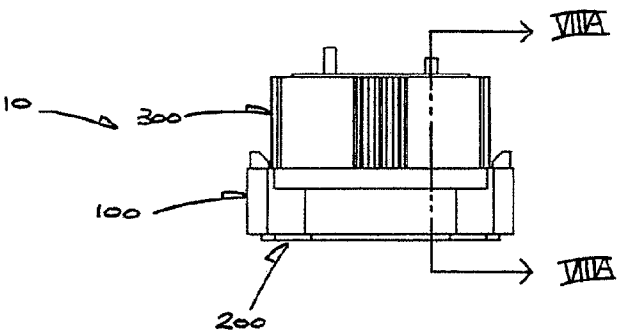
FIG. 8 is an end view similar to FIG. 7.

The operation to connect the power cable 20 is now described. The holder 200 is first slipped under the cable 20 and mounted thereon from below such that a short section of the cable 20 is located in the holder's channel 210 (FIGS. 4 and 4A). The housing 100 is then lowered onto the holder 200 until the holder's limbs 212 relatively enter through the housing 100 into the turning knob 310 with their screw threads 213 and 311 meeting each other (FIGS. 5 and 5A). Finally the turning knob 310 is tightened to draw the holder 200 closest possible further into the housing 100 through screw action between the threads 213 and 311, whilst pressing the cable 20 tight against the underside of the base wall 113 and in particular the sharp lower ends 401 of the internal connector pins 400. This results in the sharp lower ends 401 piercing into respective cores 22 of the cable 20, whereby the connector pins 400 make electrical connection with the cable 20 (FIGS. 6 and 6A).

A second electrical cable from a garden light (not shown) may now be connected to the connector pins 400 through the use of the latter's self-gripping devices G. This is conveniently done by simply inserting the end of each core of the second cable into the hub 111 through the respective hole 131, which will push upon the transverse contact end 403 of the relevant connector pin 400 behind the hole 131 and bend it inwards away from the adjacent upright contact end 402. The cable core end will finally enter into the gap between the two contact ends 403 and 402, whereupon it is gripped by them against withdrawal and in particular by the now inwardly inclined contact end 403. The first contact end 402 stays upright and provides a stationary support for the cable core end gripped by the now inclined second contact end 403.

The cable core end will be gripped automatically and simultaneously upon being inserted into the self-gripping device G provided by the two contact ends 403 and 402 of the relevant connector pin 400. Through this operation, the second cable is electrically and mechanically connected to the connector pin 400 and hence to the power cable 20, whereby the garden light is connected to the 12V power supply by the cable connector 10.

The second electrical cable may be disconnected from the cable connector 10 by simply pressing the release members 430 by their press-knobs 432 to open the self-gripping devices G as explained above (from FIGS. 7 and 7A to FIGS. 8 and 8A), whereupon this cable may be withdrawn.

As the release members 430 are pressed in a direction opposite to the direction in which the second cable is withdrawn/pulled, the two actions of pressing and pulling complement each other. In other words, the release member press-knobs 432 protrude out for depression in the same direction as insertion of the ends of the cores of the second cable.

Figure 3:
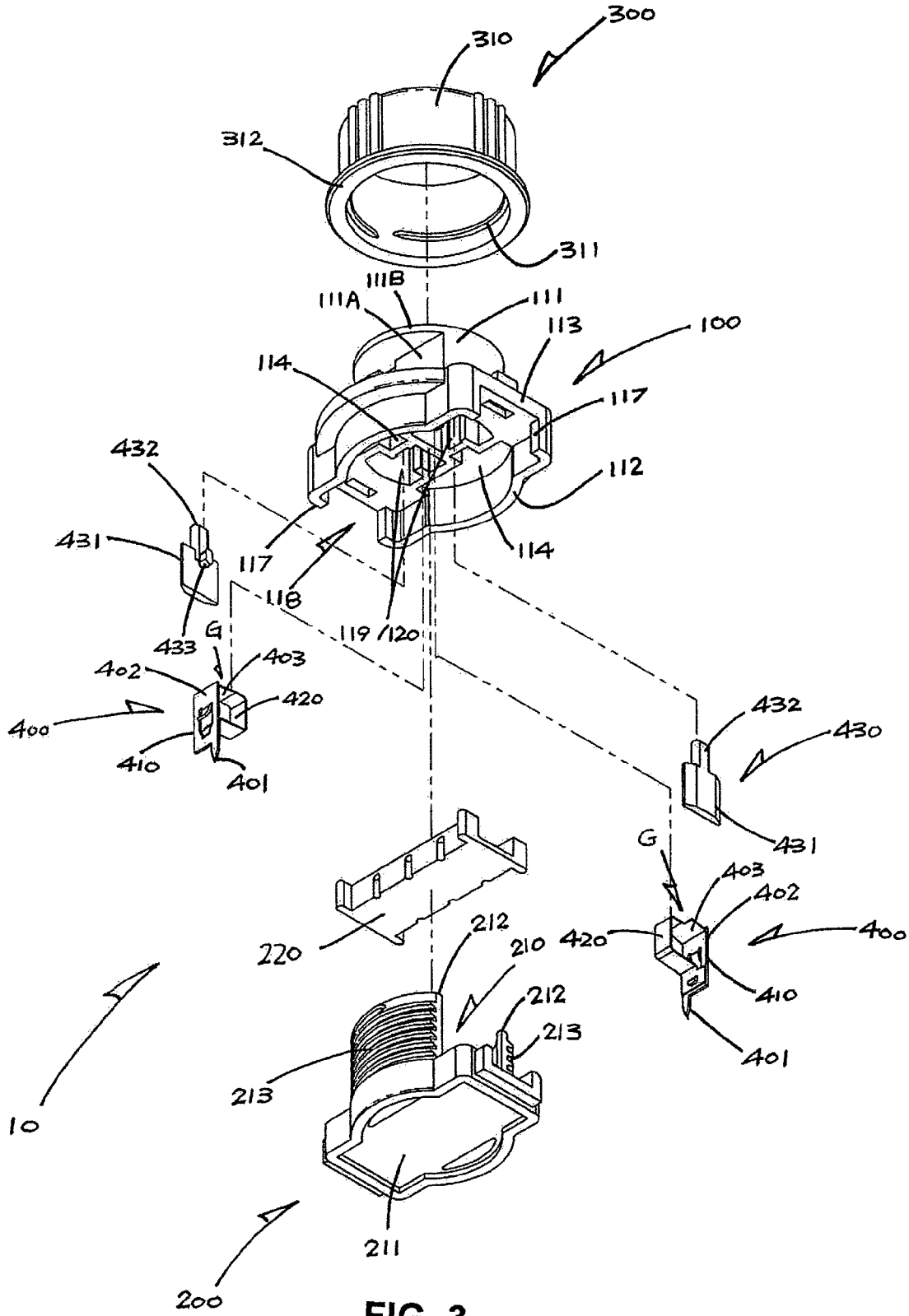
FIG. 3 is an exploded perspective view thereof, showing various components.

The cable connector 10 may include an adaptor 220 (see FIG. 3) for use in the channel 210 of the holder 200 to allow for use upon a thinner power cable.

As can be appreciated from the foregoing description, the gripping device of the subject electrical cable connector greatly facilitates both connection and disconnection of the electrical cable leading to the garden light. No tool such as a screwdriver is required, nor disassembling of the cable connector.

There is also an unexpected advantage for the electrical conductors (i.e. connector pins 400) to be located within the housing (i.e. housing 100) on which the operator (i.e. turning knob 300) is fitted. Whilst the operator is designed to be turned for drawing the holder (i.e. holder 200) close to the housing to mechanically and electrically connect the power cable, the housing should have a sufficient thickness or height to allow for relative vertical movement of the holder, and such a dimension of the housing is utilized for accommodating the electrical conductors internally.

The invention has been given by way of example only, and various other modifications of and/or alterations to the described embodiment may be made by persons skilled in the art without departing from the scope of the invention as specified in the appended claims.

The invention claimed is:

1. An electrical cable connector for use on an electrical cable for drawing electrical power, comprising:

a housing having a lower side for engaging an electrical cable and an upper side opposite the lower side;

a holder located on the lower side of the housing for relative movement to bring and hold the electrical cable into engagement with the lower side of the housing, the holder having a pair of opposed left and right limbs extending in an operating direction from the lower side to the upper side of the housing;

an operator located on the upper side of the housing for moving the holder in the operating direction, through screw action, to hold the electrical cable in engagement with the lower side of the housing; and a plurality of electrical conductors located within the housing, each of the conductors having a sharp lower end for piercing the electrical cable to make contact with a respective core of the cable upon the electrical cable being brought into engagement with the lower side of the housing, and an upper end for connection with a second electrical cable, wherein the upper end of at least one of the conductors includes a self-gripping device which operatively grips an end of a core of the second electrical cable automatically and simultaneously upon approach of the end of the core, thereby electrically and mechanically connecting the end of the core to the upper end of the at least one of the conductors.

2. The electrical cable connector as claimed in claim 1, wherein the self-gripping device comprises a resiliently bendable gripping member which is operatively bent inwardly by and upon approach of the end of the core of the second electrical cable and is co-operable with an adjacent support for subsequently gripping and connecting the end of the core.

3. The electrical cable connector as claimed in claim 2, wherein the at least one of the conductors has adjacent first and second upper ends, the first upper end providing the gripping member and the second upper end providing the support.

4. The electrical cable connector as claimed in claim 2, wherein the self-gripping device is associated with a manually-operable release member which operatively bends the gripping member inwardly to open the self-gripping device thereby releasing the end of the core of the second electrical cable.

5. The electrical cable connector as claimed in claim 4, wherein the release member is resiliently biased by the gripping member towards an inoperative position.

6. The electrical cable connector as claimed in claim 5, wherein the release member includes a press knob for manual movement from the inoperative position to an inner operative position while bending the gripping member.

7. The electrical cable connector as claimed in claim 6, wherein the housing has a wall behind which the self-gripping device and the release member are located, the wall having a first hole which exposes the gripping device for insertion of the end of the core of the second electrical cable and a second hole through which the press knob protrudes for depression in the same direction as insertion of the end of the core.

8. The electrical cable connector as claimed in claim 1, wherein the left and right limbs of the holder have external screw threads, and the operator surrounds the left and right limbs and has an internal screw thread in engagement with the screw threads of the left and right limbs for moving the holder, through screw action, the internal screw thread extending through an angle less than 360 degrees.

9. The electrical cable connector as claimed in claim 8, wherein the internal screw thread consists of one single continuous screw thread.

10. The electrical cable connector as claimed in claim 1, wherein the housing and the operator include inter-engageable elements which inter-engage through snap engagement such that the operator is rotatably engaged with the housing.

11. The electrical cable connector as claimed in claim 10, wherein the inter-engageable elements comprise a circular flange on one of the operator and housing and at least one protrusion on the other of the operator and housing, the protrusion being snappably engagable with the flange.

12. The electrical cable connector as claimed in claim 11, wherein the flange is part of the operator, and the housing includes the at least one protrusion adjacent a recess that receives the flange.

13. The electrical cable connector as claimed in claim 11, wherein the inter-engageable elements include a pair of the protrusions which are positioned on diametrically opposite sides of the flange.

* * * * *